US007021495B2

(12) United States Patent
De Laforcade

(10) Patent No.: US 7,021,495 B2
(45) Date of Patent: Apr. 4, 2006

(54) DEVICE FOR DISPENSING PRODUCT HAVING FLEXIBLE-WALLED POUCH AND AIRLESS PUMP

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 338 days.

(21) Appl. No.: 10/058,401

(22) Filed: Jan. 30, 2002

(65) Prior Publication Data

US 2002/0113093 A1 Aug. 22, 2002

(30) Foreign Application Priority Data

Jan. 30, 2001 (FR) ..... 01 01224

(51) Int. Cl.
*B65D 35/56* (2006.01)

(52) U.S. Cl. ..... 222/105; 222/321.9

(58) Field of Classification Search ..... 222/95, 222/105, 107, 321.1, 321.7, 321.9; D9/300
See application file for complete search history.

(56) References Cited

U.S. PATENT DOCUMENTS

| | | | | |
|---|---|---|---|---|
| 3,420,413 | A * | 1/1969 | Corsette | 222/107 |
| 3,995,772 | A * | 12/1976 | Liautaud | 222/83.5 |
| 4,008,830 | A * | 2/1977 | Meshberg | 222/95 |
| 4,322,020 | A * | 3/1982 | Stone | 222/105 |
| 5,056,685 | A | 10/1991 | Wild | |
| 5,156,299 | A | 10/1992 | De Caluwe et al. | |
| D338,828 | S * | 8/1993 | Segati | D9/300 |
| 5,337,921 | A * | 8/1994 | Wilson et al. | 222/105 |
| 5,497,911 | A * | 3/1996 | Ellion et al. | 222/105 |
| 5,505,338 | A * | 4/1996 | Gueret | 222/107 |
| 5,711,454 | A * | 1/1998 | Kobayashi et al. | 222/105 |
| 5,873,491 | A * | 2/1999 | Garcia et al. | 222/95 |
| 6,083,450 | A * | 7/2000 | Safian | 222/105 |
| 6,241,122 | B1 * | 6/2001 | Araki et al. | 222/107 |
| 6,266,943 | B1 * | 7/2001 | Nomoto et al. | 53/410 |
| 6,467,653 | B1 * | 10/2002 | Hamamoto et al. | 222/105 |
| 2003/0226856 | A1 * | 12/2003 | Nakamura et al. | 222/105 |

FOREIGN PATENT DOCUMENTS

| | | |
|---|---|---|
| DE | 77 07 773 | 1/1980 |
| EP | 0 182 094 | 5/1986 |
| EP | 0 622 311 A2 | 11/1994 |
| EP | 0 759 399 | 2/1997 |
| GB | 1 601 424 | 10/1981 |
| JP | 58-30964 | 2/1983 |
| JP | 06135474 A * | 5/1994 |
| JP | 6-312019 | 11/1994 |
| JP | 8-156973 | 6/1996 |

(Continued)

OTHER PUBLICATIONS

JP 9-77136 A Patent abstracst of Japan and Computer Translation□□from Japan Patent Office: http://www.ipdl.jpo.go.jp/homepg_e.ipdl.*

(Continued)

*Primary Examiner*—Philippe Derakshani
(74) *Attorney, Agent, or Firm*—Finnegan, Henderson, Farabow, Garrett and Dunner LLP

(57) ABSTRACT

The present application relates to a device for dispensing product and a related method of using the device, the device comprising a flexible walled pouch configured to contain product. The pouch may be in fluid communication with an airless pump equipped with a dip tube having a free end that lies substantially mid-way along the axial height of the pouch. The pouch may be in a container.

94 Claims, 6 Drawing Sheets

FOREIGN PATENT DOCUMENTS

| | | | |
|---|---|---|---|
| JP | 9-77136 | | 3/1997 |
| JP | 09077137 A | * | 3/1997 |
| JP | 11-79245 | | 3/1999 |
| JP | 11292076 A | * | 10/1999 |

OTHER PUBLICATIONS

Translation of JP 9-77136 Laminated Bottle (Takao Kishi).*
Computer Translation of JP 9-77136 Laminated Bottle (Takao Kishi).*
English language translation of DE 77 07 773, Jan. 31, 1980.
English language Derwent Abstract of EP 0 182 094, May 28, 1986.
English language abstract of JP 9-77136, Mar. 25, 1997.
English Translation of Notice of Rejection Issued Jun. 15, 2004, Japanese Patent Application No. 2002-022337.
English Translation of Decision of Rejection Issued Mar. 8, 2005, Japanese Patent Application No. 2002-022337.

* cited by examiner

DEVICE FOR DISPENSING PRODUCT HAVING FLEXIBLE-WALLED POUCH AND AIRLESS PUMP

The present invention relates to a device for using a pump to dispense a product, for example, a cosmetic product chosen from hair products, personal hygiene products, care products, makeup products and sunscreens that may protect the skin against the harmful effects of solar radiation.

Products packaged in bottles equipped with a pump are currently in fashion, and their market is ever increasing. This trend applies to many types of products, such as personal hygiene products and sunscreens, for example.

One of the disadvantages associated with the use of these pump-action bottles stems from their orientation in use. Typically, because of the presence of a dip tube, a free end of which lies near the bottom of the container, the bottle has to be used in a head-up, or upright, fashion where, with respect to the ground, the head is positioned above the pouch and the pouch extends in a direction pointing substantially straight down to the ground. This condition is dictated by the fact that the free end of the dip tube should always be immersed in the product to be dispensed in order to maintain proper function.

Systems without a dip tube have been proposed, intended to operate in a position with the dispensing head facing in a downward direction, or a head-down fashion, where, with respect to the ground, the head is positioned below the pouch and the pouch extends in a direction pointing substantially away from the ground. With such systems, however, the pump often loses its prime the first time the device is used in a head-up position with the dispensing head facing in an upward direction.

There are also devices of the flexible pouch type, equipped with an airless pump and using no dip tube. Although satisfactory in numerous regards, such systems do, however, require the pouch to be filled under vacuum so as to eliminate any volume air above the product. Furthermore, this absence of air can be difficult to maintain throughout the service life of the device, such as with products that may evaporate over time, producing gases inside the pouch.

Systems employing a ball, the position of which in theory allows the device to be used either head-up (upright) or head-down (upside-down), have also been proposed. The problem then arises when the device is used in a horizontal position, where the head and the pouch extend approximately in a plane that is substantially parallel to the ground. This horizontal position is something that may occur relatively frequently when dispensing products such as deodorants. In this position, the position of the ball fluctuates between its head-up operating position and its head-down operating position. This often results in the pump losing its prime.

German reference GE 77 07 773 describes a device equipped with a pump, and comprising an outside container and an inside bag formed of a rubber-like material. The pump is connected to a dip tube. The elasticity of the material causes the walls of the pouch to elastically retract as the product is dispensed via the pump so that, at the end, the pouch is substantially in contact with the dip tube.

There are many drawbacks to such a configuration. First, the pouch has to be filled under pressure in order to overcome the elasticity of the material forming the inner pouch. Also, the pressure inside the pouch will vary in a substantial way from the first use to the last use, which may be problematic for the operation of the pump. Because of the elasticity of the pouch, the risk is high for the pouch to obstruct the orifice of the dip tube. The risk is also high, depending on the thickness of the walls of the pouch, for the end of the dip tube to pierce the walls of the pouch. Furthermore, the impermeability of the rubber-like materials used in this device, and their compatibility with some compounds commonly used in cosmetics, are generally found to be very far from being satisfactory.

Hence, one of the aspects of the invention is to provide a packaging and dispensing device, equipped with a pump, and capable of operating, for as long as possible, regardless of the position of the device, for example, when the device is in a horizontal position.

Another aspect of the invention is to provide a device that is capable of allowing the container to be emptied as completely as possible.

A further aspect of the invention is to provide a device that does not require the flexible pouch containing the product to be filled under vacuum.

Another object of the invention is to produce a device that is simple to use, reliable, and economical to produce.

Other aspects still will become apparent from the detailed description that follows. It should be understood that the invention, in its broadest sense, could be practiced without accomplishing one or more of the aspects described herein.

In one aspect, there is a device in the form of a container inside which there is arranged a flexible-walled pouch having an interior for containing the product. Flexible-walled pouches may include pouches formed with a single wall or multiple walls. These pouches may also be formed of a single piece or multiple pieces of material. The interior of the pouch may be in fluid communication with an airless pump equipped with a dip tube, a free end of which lies substantially at a mid-point of the axial height of the pouch. The device may also have at least one passage allowing for air entry into the container and outside the pouch, for example, as the product is pumped out from the pouch. In addition, the pressure inside the pouch, at least prior to the first use of the device, may be less than, or substantially equal to, the atmospheric pressure. In this sense, "atmospheric pressure" is being used to define the pressure encountered by the exterior of the device. For example, when the device includes an exterior container, the atmospheric pressure may relate to the pressure encountered by the exterior surface of the container.

By "substantially equal", it is meant that there may be a slight pressure increase inside the pouch due to external factors, for example due to a temperature increase inside the pouch. With the disappearance of the outside factor, the pressure generally may go back to the atmospheric pressure. In contrast, in DE 77 07 773, the pressure maintained on the product in the inner bag is the result of the configuration of the device, i.e., the elasticity of the walls of the bag, and is maintained from the first use to the last use.

In one aspect of the invention, the filling of the pouch may occur at the atmospheric pressure, and this atmospheric pressure inside the pouch may be maintained substantially from the first use to the last use.

The air entry outside the pouch may allow for maintaining the volume surrounding the pouch substantially at the atmospheric pressure, thus facilitating the appropriate compression of the pouch as the product is pumped out from the pouch.

By "substantially at a mid-point of the axial height of the pouch" it is meant that the free end of the dip tube is closer to the mid-axial height of the pouch than it is to either of the ends of the pouch. Optionally, the free end of the dip tub may be located as close as possible to the mid-axial height of the pouch.

An "airless pump" is a pump that is configured so that it does not allow air into the pouch containing the product to replace the volume of product taken up during actuation of the pump. When the device includes a container, the resulting reduction in the volume of the pouch is compensated for by letting air in around the outside of the pouch, that is to say into the volume lying between the external container and the pouch, until a pressure substantially equal to atmospheric pressure is obtained in the volume.

As the product is pumped out from the pouch, the pouch may compress in such a way that the volume of the pouch above the free end of the tube is substantially equal to the volume of the pouch below said free end of the tube. The term "substantially equal", in reference to the volume of the pouch, is to be understood as meaning a difference in volume of approximately 25% or less, and may be 10% or less, or even 5% or less. As a result of this similar compression of the pouch above the free end of the dip tube and below it, as long as the depression created by the pump is sufficient to cause a reduction in the volume of the pouch, the level of product inside the pouch may not decrease substantially. In other words, the volume may decrease, but because of the collapsing of the pouch, the level of product in the pouch may remain substantially the same throughout the use of the device. Therefore, regardless of the position of the device (head-up, head-down, inclined or horizontal) during the pumping of substantially the entire contents of the pouch, the free end of the dip tube may remain immersed in the product. With at least some exemplary embodiments of the invention, the pump, therefore, may not lose its prime.

Unlike certain pouch systems without dip tubes, at least some exemplary embodiments may have a pouch that may be filled without placing the pouch under vacuum. According to at least some exemplary embodiments of the invention, the presence of a volume of air above the liquid level may not affect the correct operation of the device as long as the free end of the dip tube is immersed in the product. The filling level, however, may be chosen as high as possible, and in any event, may above the free end of the dip tube.

Optionally, the free end of the dip tube, when it is arranged mid way up the height of the pouch, may be at the center of a "virtual sphere" described by the surface of the product when the device is moved in multiple possible directions about the point corresponding to the free end.

From a practical point of view, it appears that according to one optional aspect of the invention, even in one simple configuration that is without fixing zones (described bellow), substantially all of the product may be pumped out, regardless of the position of the device (head-up, head-down, inclined or horizontal). "Substantially all of the product", as used in reference to a volume of product that may be pumped out of the pouch, is to be understood to refer to a volume of product greater than 50% of the total volume of the product (prior to a first use of the device), or greater than 75% of the total product, or greater than 85% of the total product. Beyond 85 to 90%, problems may possibly appear when pumping occurs with the device in the horizontal position. Then, for the last 5 to 7% of product, there might optionally be a preferred pumping position, either head-up or head-down, depending on the configuration of the device. Those performances, for certain applications, may be considered as very satisfactory, especially when the device has simplicity and low cost.

The quantity of product that can be pumped out, regardless of the position of the device, may be possibly increased by fixing the pouch to the inner wall of the container along at least one area extending longitudinally to the axis of the pouch. Those fixing areas may allow for a better control of the way the pouch compresses as the product is pumped out, and thus may help in maintaining the same volume above the free end of the dip tube and below the free end. In this way, it may be possible for the volume difference not to exceed that caused by the differences in shape inherent to the presence of any neck there might be and of a flat bottom of the outside container.

The pouch (e.g., a cross section of the pouch) and an arrangement of the fixing region(s) may be chosen so that as the product is pumped from inside the pouch, the cross section of the pouch may decrease while remaining over at least a portion of its axial height containing the free end of the tube, substantially symmetrical with respect to a mid-plane containing the free end and perpendicular to the device axis. Maintaining this symmetry with respect to the free end of the dip tube (this symmetry may extending over most of the axial height of the pouch) may facilitate to a large extent the maintaining of identical or almost identical pouch volumes above the free end of the dip tube and below the free end as more and more product is pumped out.

According to one aspect, the pouch (or a cross section of the pouch), and the arrangement of the fixing region(s) may be chosen so that, as the product is pumped from inside the pouch, the cross section of the pouch may decrease, maintaining over at least the axial portion, a substantially symmetric shape with respect to an axis containing the dip tube. This arrangement may make it possible to reduce as far as possible the "dead volume" which may be difficult to pump out. Furthermore, it may make the design of the device easier.

The pouch may be capable of moving from a first position in which it may have a maximum cross section, or define a maximum volume, into a second position in which it may have a minimum cross section, or define a minimum volume. When the pouch is in the second position, it may be close to or even in contact with the dip tube along a number of longitudinal regions. Once again, this arrangement may play a part in reducing the dead volume mentioned above.

In an optional aspect, the internal cross section, or internal shape of the container may be of a shape substantially identical to the shape of the cross section of the pouch, or the pouch itself, when the pouch is in the first position. This arrangement may make it possible to optimize the volume of product contained in the device and to make the device easier to produce, such as if it is produced by co-extrusion.

Also as an option, the cross section of the pouch and the arrangement of the fixing region(s) may be chosen so that the profile of the pouch portion running between two consecutive fixing regions deforms substantially symmetrically with respect to the mid-plane passing through the two said regions. Put another way, the pouch may be substantially symmetrical as it deforms with respect to a plane passing through the axis of the dip tube and a mid-point between two consecutive fixing regions. This arrangement may make it easier to fully empty the device, and may play a part in making it easier to keep the volume of product in the pouch at a constant level.

As another option, the plane may intersect, substantially at its middle, the length of straight line connecting the dip tube to the point of the cross section furthest away from the dip tube when the pouch is in the first position. Thus, in the second position the portion that, in the first position, is furthest away from the dip tube may be more or less in contact with the dip tube.

In one option, the fixing region(s) may run continuously along substantially the entire height of the pouch so that the axial portion corresponds generally to the axial height of the pouch. This arrangement may play a part in making it easier to maintain equal pouch volumes below and above the free end of the dip tube, and in reducing as far as possible the variations in product level which may be generated by pumping from inside the pouch.

The cross section of the pouch may be of symmetric shape about an axis. For example, when the pouch is in the first position, it may have at least four sides, the pouch being fixed to the container along N longitudinal fixing regions (N greater than or equal to 3) arranged along axes of symmetry of order N of the cross section.

According to one aspect, when the pouch is in the first position, the cross section may be of square shape with a longitudinal fixing region running along the middle of each face of the cross section. There may be, therefore, four fixing lines fixing the pouch to the interior surface of the external container.

According to another aspect, when the pouch is in the first position, the cross section may be of hexagonal shape with a longitudinal fixing region running along every second corner of the cross section. There may be, therefore, three fixing lines fixing the pouch to the interior surface of the external container.

The cross section of the pouch may be at a maximum substantially mid-way up its height, and may decrease gradually in the direction of each of its ends. In other words, the pouch may be wider at its middle and tapers towards either end. The reduction, or taper, may be symmetric on each side of the transverse mid-plane of the pouch. This arrangement may be good for reducing the dead volume discussed above and for allowing operation in all positions for as long as possible.

As an option, the air intake means may comprise one or more orifices (e.g., slots) formed in the bottom of the device. Such orifices may result from the use of first and second materials that are physically and chemically incompatible for forming, on the one hand, the external container and, on the other hand, the flexible pouch, and from producing the device by co-extrusion. In effect, in this configuration, in the region of the bottom of the device, the walls of the pouch may resist the welding of the edges of the external container, thus generating an air intake slot in the bottom of the device.

The fixing region(s) may be achieved using a third material, for example, thermoplastic, that is physically and chemically compatible with the first and second materials. This may, for example, be an adhesive.

By way of examples, the first material may be chosen from polyethylenes terephthalates, ABSs, and styrenes.

Also by way of example, the second material may be chosen from polypropylenes and polyethylenes.

By way of examples, the third material may be chosen from a resin marketed by MITSUI™, under the trade name ADMER™ (grade SF 600, SE 800 or SF 620E) or of a resin marketed by ATO™ under the trade name LOTADER™ (grade TX8030 or HX8020).

The pump may be mounted on the device by, for example, crimping or screwing.

As an option, the device may be equipped with a dispensing head for actuating the pump and dispensing the product via at least one dispensing orifice. The dispensing orifice may be formed in, for example, a nozzle, a grating, or in an element made of a porous material, such as a sintered material or a foam, among others.

The device may be suited to packaging and dispensing a cosmetic product, for example, personal hygiene products, scents, makeup products, hair products, care products, or sunscreens.

In another aspect, the device may comprise a container and a flexible-walled pouch inside the container with the flexible-walled pouch comprising an interior configured to contain the product. A dip tube may also be provided extending in the interior of the pouch and having a free end located substantially at a mid-point of an axial height of the pouch. Also, an airless pump may be in fluid communication with the interior of the flexible-walled pouch via the dip tube and the device may have at least one passage configured to allow air entry into the container and outside of the pouch. In addition, the flexible pouch may comprise a substantially non-elastically deformable material.

In another aspect, the device may comprise a container and a flexible-walled pouch inside the container with the flexible-walled pouch comprising an interior configured to contain the product. A dip tube may also be provided extending in the interior of the pouch and having a free end located substantially at a mid-point of an axial height of the pouch. Also, an airless pump may be in fluid communication with the interior of the flexible-walled pouch via the dip tube and the device may have at least one passage configured to allow air entry into the container and outside of the pouch. In addition, said pouch may be fixed longitudinally to an interior wall of the container along at least one fixing region.

In one aspect, the pouch and the at least one fixing region may be configured so that, as product is pumped from the interior of the pouch, a volume defined by the pouch above the free end of the dip tube remains substantially equal to a volume defined by the pouch below the free end of the dip tube.

In another aspect, the pouch and the at least one fixing region may be configured so that as product is pumped from inside the interior of the pouch, a volume defined by the pouch decreases while cross sections of the pouch located along at least a portion of its axial height remain substantially symmetrical with respect to a mid cross sectional plane containing the free end of the dip tube.

In yet another aspect, the pouch and the at least one fixing region may be configured so that as the product is pumped from the interior of the pouch, cross sections of the pouch located along said at least a portion of its axial height maintain a substantially symmetric shape with respect to an axis containing the dip tube.

In another option, the pouch may be formed of a substantially non-elastic material and further may be deformable.

According to another aspect, the pouch and the plurality of fixing regions may be configured so that a profile of a portion of the pouch extending between two adjacent fixing regions deforms substantially symmetrically with respect to a plane passing through an axis of the dip tube and a midpoint between the two adjacent fixing regions.

According to yet another aspect, a device for dispensing a product may be provided, comprising a container; a flexible-walled pouch inside the container, the flexible-walled pouch comprising an interior; a product contained in the interior of the pouch; a dip tube extending in the interior of the pouch; an airless pump in fluid communication with the interior of the flexible-walled pouch via the dip tube; and at least one passage configured to allow air entry into the container and outside of the pouch, wherein pressure in the interior of the pouch, at least prior to first use of the device, is less than or substantially equal to atmospheric pressure, and wherein the device is configured so that substantially all of the product contained in the pouch is dispensed via the airless pump regardless of whether the device is oriented in a head-up position or a head-down position.

According to another aspect, a device for dispensing a product may be provided, comprising a container; a flexible-walled pouch inside the container, the flexible-walled pouch comprising an interior configured to contain the product; a dip tube extending in the interior of the pouch; an airless pump in fluid communication with the interior of the flexible-walled pouch via the dip tube; and at least one passage configured to allow air entry into the container and outside of the pouch, wherein the flexible pouch comprises a substantially non-elastically deformable material, and wherein the device is configured so that substantially all of the product contained in the pouch is dispensed via the airless pump regardless of whether the device is oriented in a head-up position or a head-down position.

In another aspect, a device for dispensing a product may be provided, comprising a container; a flexible-walled pouch inside the container, the flexible-walled pouch comprising an interior configured to contain the product; a dip tube extending in the interior of the pouch; an airless pump in fluid communication with the interior of the flexible-walled pouch via the dip tube; and at least one passage configured to allow air entry into the container and outside of the pouch, wherein said pouch is fixed longitudinally to an interior wall of the container along at least one fixing region, and wherein the device is configured so that substantially all of the product contained in the pouch is dispensed via the airless pump regardless of whether the device is oriented in a head-up position or a head-down position.

In yet another aspect, a device for dispensing a product may be provided, comprising a flexible-walled pouch, the flexible-walled pouch comprising an interior; a product contained in the interior of the pouch; a dip tube extending in the interior of the pouch, the dip tube having a free end; and an airless pump in fluid communication with the interior of the flexible-walled pouch via the dip tube, wherein pressure in the interior of the pouch, at least prior to first use of the device, is less than or substantially equal to atmospheric pressure, and wherein the device is configured so that substantially all of the product contained in the pouch is dispensed via the airless pump regardless of whether the device is oriented in a head-up position or a head-down position.

According to another aspect, a device for dispensing a product may be provided, comprising a flexible-walled pouch, the flexible-walled pouch comprising an interior configured to contain the product; a dip tube extending in the interior of the pouch, the dip tube having a free end; and an airless pump in fluid communication with the interior of the flexible-walled pouch via the dip tube, wherein the flexible pouch comprises a substantially non-elastically deformable material, and wherein the device is configured so that substantially all of the product contained in the pouch is dispensed via the airless pump regardless of whether the device is oriented in a head-up position or a head-down position.

According to yet another aspect, a device for dispensing a product may be provided, comprising a flexible-walled pouch, the flexible-walled pouch comprising an interior; a product contained in the interior of the pouch; a dip tube extending in the interior of the pouch, the dip tube having a free end located substantially at a mid-point of an axial height of the pouch; and an airless pump in fluid communication with the interior of the flexible-walled pouch via the dip tube, wherein pressure in the interior of the pouch, at least prior to first use of the device, is less than or substantially equal to atmospheric pressure.

In one aspect, a device for dispensing a product may be provided, comprising a flexible-walled pouch, the flexible-walled pouch comprising an interior; a product contained in the interior of the pouch; a dip tube extending in the interior of the pouch, the dip tube having a free end located substantially at a mid-point of an axial height of the pouch; and an airless pump in fluid communication with the interior of the flexible-walled pouch via the dip tube, wherein the flexible pouch comprises a substantially non-elastically deformable material.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

According to another aspect, a method may be provided comprising providing a device according to any of the aspects disclosed herein comprising a product contained in the pouch, wherein the product comprises a cosmetic product; and actuating the airless pump to cause product from the pouch to be dispensed onto an exterior body portion.

According to another aspect of the method, the exterior body portion may comprise skin.

According to yet another aspect of the method, the exterior body portion may comprise hair.

In another aspect of the method, the cosmetic product may be chosen from personal hygiene products, scents, makeup products, hair products, care products, and sunscreens.

In yet another aspect, the method may further comprise changing orientation of the device from one of a head-up orientation and a head-down orientation to the other of the head-up orientation and the head-down orientation and maintaining the free end of the dip tube in contact with product contained in the pouch both before and after the changing of the orientation.

As used herein, the phrase substantially all of the product contained in the pouch is dispensed "via the airless pump regardless of whether the device is oriented in a head-up position or head-down position" relates to being able to dispense product by actuating the pump while the device is in either the head-up position or the head-down (or a combination of the two), up until substantially all of the product is dispensed. In other words, the head-up position or head-down position (or a combination of the two) could be used up until substantially all of the product is dispensed.

In another aspect of the method, the maintaining may occur until substantially all of the product in the pouch is dispensed.

According to another aspect of the method, the device may further comprise a container inside of which the pouch is located.

In another aspect of the method, the pouch may be fixed longitudinally to an interior of the container along at least one fixing region The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a perspective view of an exemplary embodiment of the device;

Figure 1:
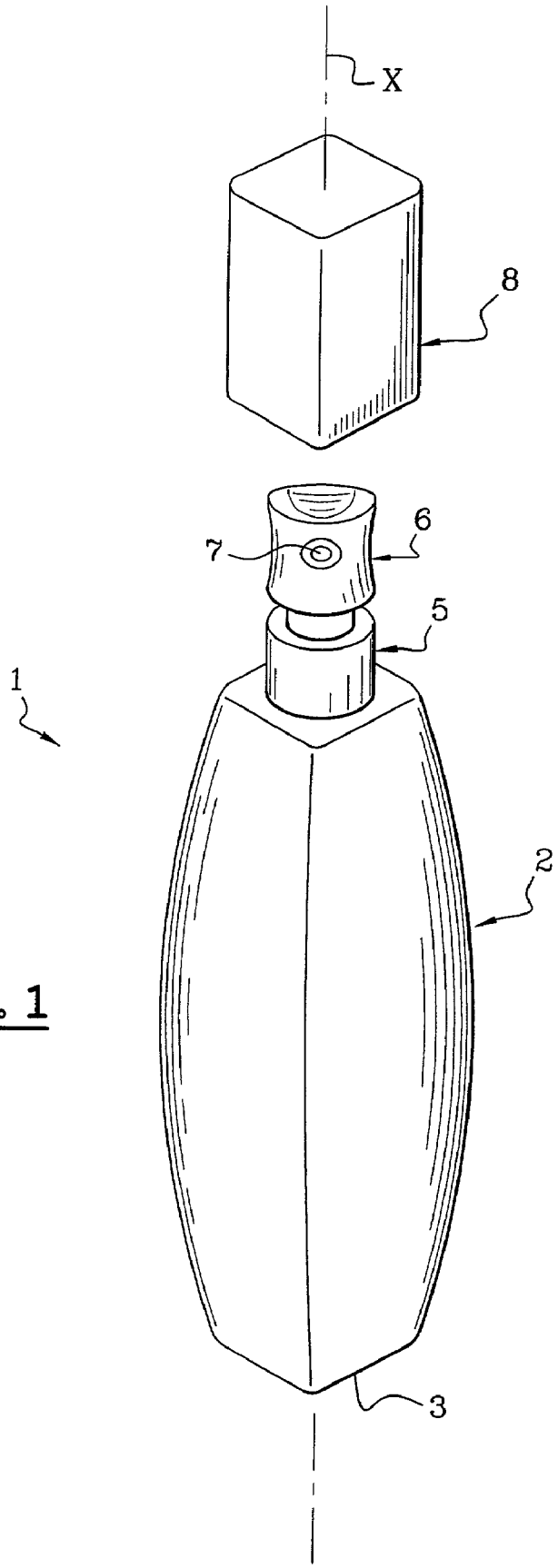

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes or numerical prefixes are used to refer to similar parts.

The device 1 described with reference to FIGS. 1, 2, 3A–3D, 4 and 5 is of an overall shape that is elongate along a longitudinal axis X. The device 1 comprises a rigid or semi-rigid external container 2 that may be made of polyethylene terephthalate. The external container 2 may be of square cross section with rounded corners. The external cross section is a maximum at the transverse mid-plane of the container 2 and decreases gradually towards its two ends, this being done symmetrically with respect to the transverse mid-plane. At one of its ends, the container 2 ends in a flat bottom 3. At the other end, it ends in an open neck 4 inside which an airless pump 5 is mounted by, for example, snap-fastening or crimping. An actuator in the form of a push-button 6 is mounted on pump 5 for operating the pump, and for dispensing the product via at least one outlet orifice 7. A removable cap 8 may cover the push-button 7 when the device is in, for example, the storage or transport position.

Figure 2:
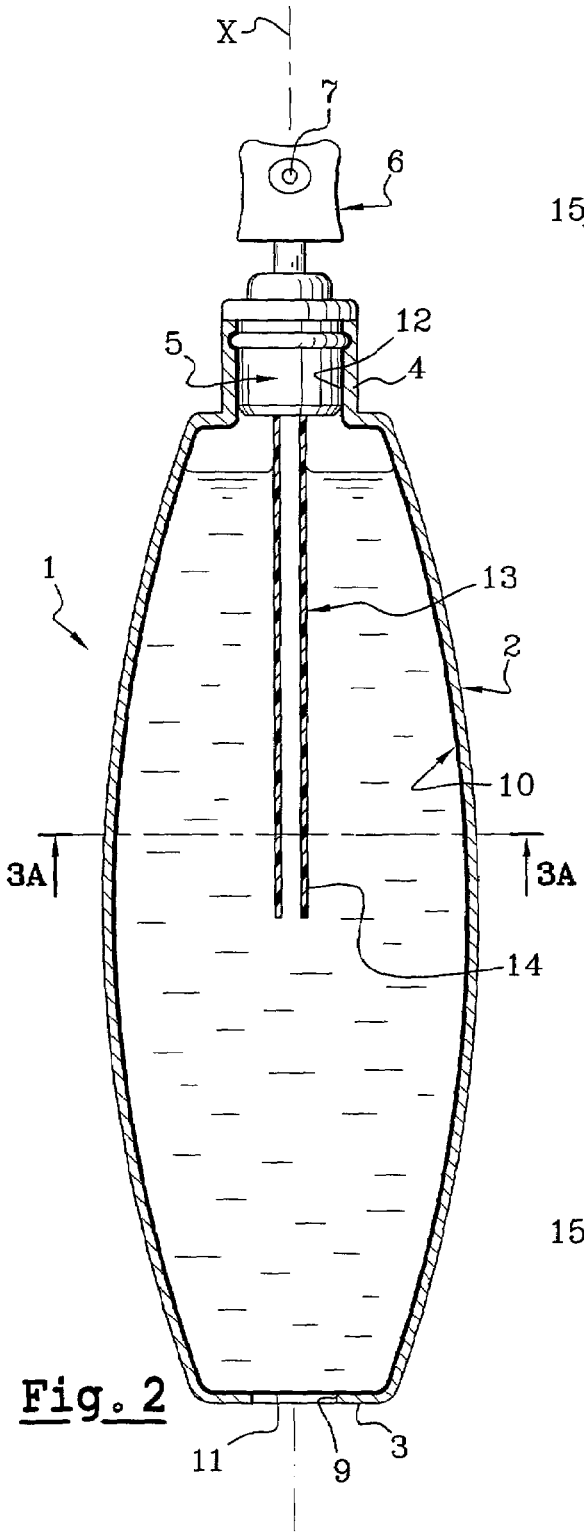
FIG. 2 is a cross section view of the device of FIG. 1 along section line 2 shown in FIG. 3A and depicts the device in a first, substantially filled, position.
Figure 3A:
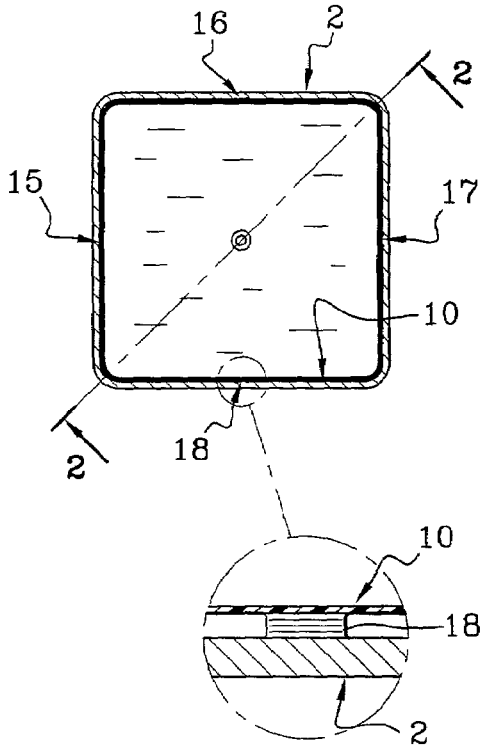
FIG. 3A is a cross section view of the device of FIG. 1 along section line 3A shown in FIG. 2 and includes a magnified portion showing a fixing region of the device.

Arranged inside the rigid or semi-rigid external container 2 is a flexible-walled pouch 10 that, in the position of maximum expansion (as depicted in FIGS. 2 and 3A), is of a cross section similar to the interior cross section of the external container 2. Thus, in this position of maximum filling, the walls of the pouch 10 substantially hug the interior walls of the container 2. The pouch 10 is of a height substantially identical to the height of the external container 2 and ends at one end in a closed bottom 11 and, at the other end, in an open edge 12 held in the neck 4 of the external container 2 by being trapped between the latter and the body of the pump 5.

The pouch 10 may be made of a thermoplastic material that is physically and chemically incompatible with the material forming the external container 2. According to this example, use is made of a pouch made of polyethylene.

The airless pump 5 here is in fluid communication with the flexible pouch 10 that contains the product that is to be dispensed. The pump is supplied with product via a dip tube 13, the free end of which is substantially mid-way up the axial height of the pouch 10 (excluding the neck), although it may be possible to locate the free end at a position other than mid-way up the axial height.

As is more clearly apparent in FIG. 3A, the pouch 10 is affixed, for example, by welding, to the interior wall of the external container 2 along four fixing lines or regions 15, 16, 17, 18 arranged along axes of symmetry of order 4 of the square defined by the cross section of the pouch 10. Thus, the fixing regions each run along the middle of one face of the square formed by the cross section of the external container 2 and run along substantially the entire height (excluding the neck) of the external container 2.

The device according to this embodiment may be produced by co-extrusion, the co-extruded portion comprising a continuous outer layer intended to form the external container 2, a continuous inner layer intended to form the pouch 10, and a discontinuous layer between the internal layer and the external layer and which is intended to form the four longitudinal fixing regions 15, 16, 17, 18.

The discontinuous layer may be formed of a material that is compatible both with the material of the outer layer and with the material of the inner layer. By way of example, use may be made of a resin marketed by MITSUI™ under the trade name ADMER™ (grade SF 600, SE 800 or SF 620E). By way of a further example, use may be made of a resin marketed by ATO™ under the trade name LOTADER™ (grade TX8030 or HX8020).

As the material of which the discontinuous layer is formed may be compatible with the materials of which the inner and outer layers are formed, the inner layer may stick to the outer layer via the four longitudinal strips 15, 16, 17, 18 formed by the discontinuous layer.

The portion thus formed may be introduced into a mould with the shape and size desired for the device. Upon closure of the mould, the flexible pouch may close continuously, including at the bottom. By contrast, in the region where the bottom joins up, the edges of the flexible pouch may position themselves between the two edges of the external container and, because of the incompatibility between the materials of which the flexible pouch and the external container are formed, may prevent the edges from welding together, thus leaving in the bottom of the external container, after release from the mould and removal of the pinching region from the mould, a slot 9 allowing air to be taken into the volume delimited between the flexible pouch 10 and the external container 2.

As can be seen in FIG. 2, the flexible pouch 10 is filled with product, substantially up to the neck 4 of the container 2, and in any event well above the free end 14 of the dip tube 13.

In use, by operating the pump 5 using the push-button 6, a dose of product may be dispensed from the flexible pouch 10. In response to the dispensing of this dose, and because of the absence of air intake into the flexible pouch, a depression may be created inside the latter, which depression may cause the walls of the pouch to cave in towards the dip tube. The caving in of the walls of the flexible pouch 10 may take place in an organized fashion because of the presence of the welded regions 15, 16, 17, 18 via which the pouch 10 is fixed to the external container 2.

Figure 3B:
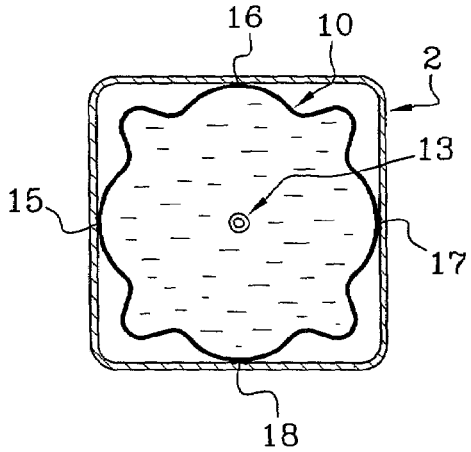
FIGS. 3B–3D are cross section views of the device and depict various stages of the device as product is pumped out of the device.
Figure 3C:
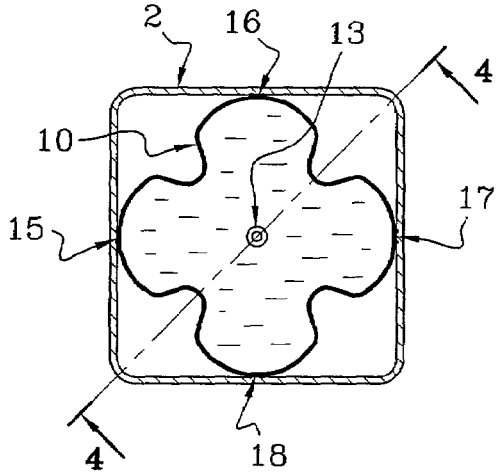
Figure 3D:
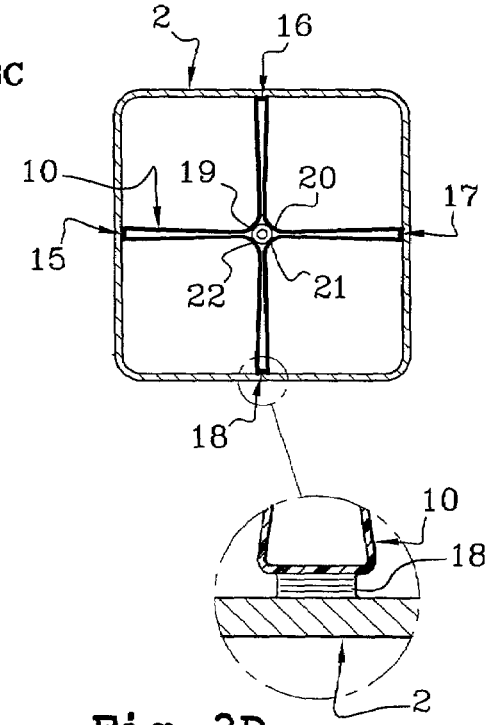

FIGS. 3A–3D illustrate examples of various profiles the flexible pouch 10 may occupy between the position of substantially maximum filling (FIG. 3A) and the position of substantially maximum emptying (FIG. 3D).

In FIG. 3A, the walls of the flexible pouch 10 stick substantially perfectly to the interior walls of the external container 2.

In FIG. 3B, after several pumping operations, the corners of the pouch have begun their movement converging towards the axis X of the device, and have done so along the entire height of the pouch. Thus, the pouch may maintain a cross section that may be symmetric on the one hand with respect to its transverse mid-plane and on the other hand right around the axis X containing the dip tube 13. This may result in a reduction of the cross section of the pouch that is uniform over its entire height, making it possible to maintain practically equal volumes above and below the free end of the dip tube and to keep the product inside the flexible pouch 10 at a substantially constant level.

In FIG. 3C, the converging movement of the four corners of the pouch 10 towards the dip tube continues as pumping progresses, until the profile of the pouch between two consecutive fixing regions 15, 16, 17, 18 is substantially inverted (FIG. 3D). As can be seen in FIGS. 3A–3D, the inversion of the profile may occur symmetrically with respect to the mid-plane passing between two consecutive welding regions.

In the position of FIG. 3D, the four corners of the pouch are in contact with the dip tube along four longitudinal regions 19, 20, 21, 22, the pouch moreover being kept fixed to the external container at the middle of each of its four faces. As can be seen in FIG. 3D, in this position, the volume of the pouch is now practically zero, the change from maximum volume (FIG. 3A) to minimum volume (FIG. 3D) having been achieved while at the same time constantly maintaining symmetry of the pouch on the one hand with respect to the transverse mid-plane of the pouch and, on the other hand, of the cross section of the pouch about the axis X of the device.

The result of this may be that in moving of the configuration of FIG. 3A to the configuration of FIG. 3D, in spite of the reduction in volume of the pouch 10, the product level inside the latter may not change significantly. The immersion of the free end 14 of the dip tube 13 in the product may be prolonged for as long as possible because of the cross section of the pouch decreasing gradually from its ends towards its transverse mid-plane in which the free end of the dip tube 13 lies.

At the end of use of the device, when the depression created by the pump may become insufficient to compress the pouch further, the product level in the pouch may fall until it drops below the free end of the dip tube. At this instant, product may no longer be pumped out. This residual volume may lie essentially around the dip tube and near the joining regions.

Before reaching this stage where the product may no longer be pumped out, it may be possible that there will be an intermediate phase in which pumping can only take place with the device in one particular position (either head-up or head-down). In practice, it may be appropriate to contrive for these phases during which pumping may no longer take place, or may take place only in one orientation, to be as short as possible.

Figure 4:
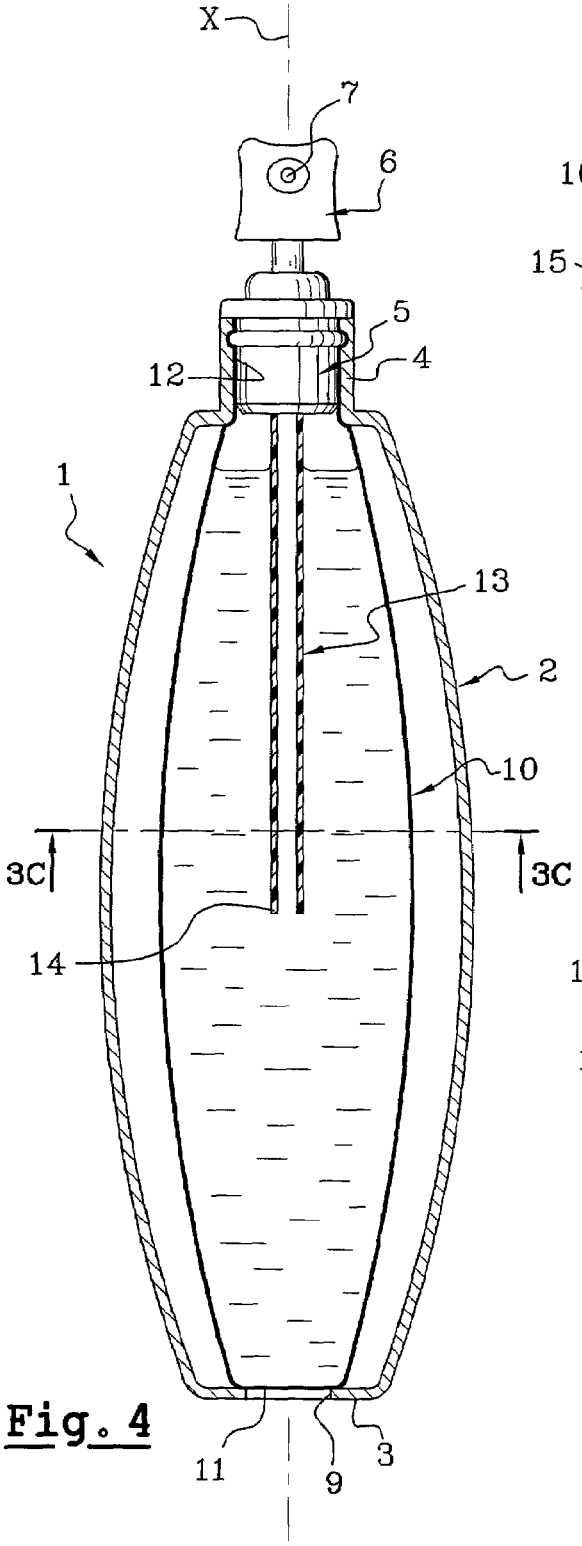
FIG. 4 is a cross section view of the device in the stage shown in FIG. 3C.
Figure 5:
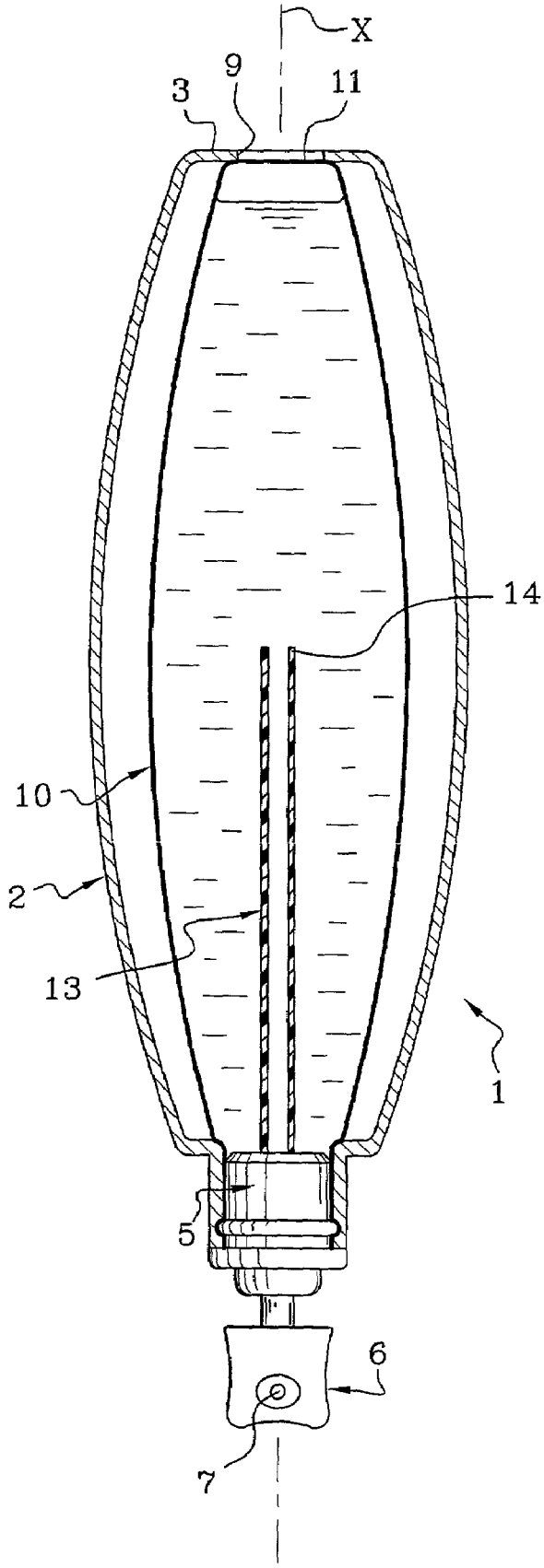
FIG. 5 is a cross section view relating to FIG. 3C showing the device in a head-down orientation.

FIGS. 4 and 5 show a view in longitudinal section of the device for an intermediate position of compression of the pouch as depicted in the view in cross section of FIG. 3C. As can be seen in these figures, the product level inside the pouch is substantially identical to the product level prior to first use of the device (FIG. 2). In both positions, head-up and head-down, the free end 14 of the dip tube may be, to a great extent, immersed in the product. The same may be true when the device is used in a horizontal position.

Figure 6A:
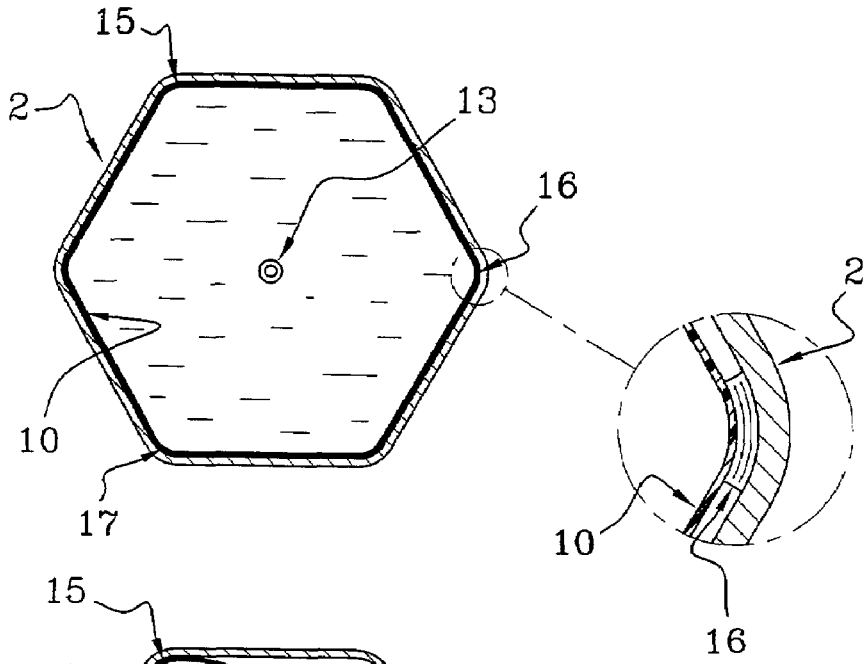
FIGS. 6A–6C are cross section views of a second exemplary embodiment of the device and depict various stages of the device as product is pumped from the device.
Figure 6B:
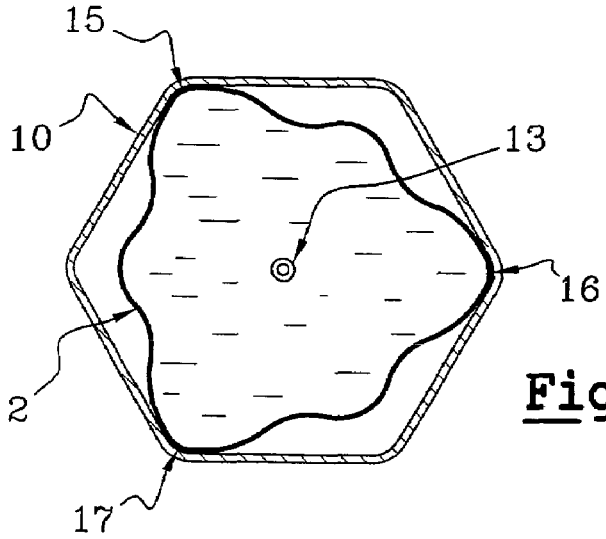
Figure 6C:
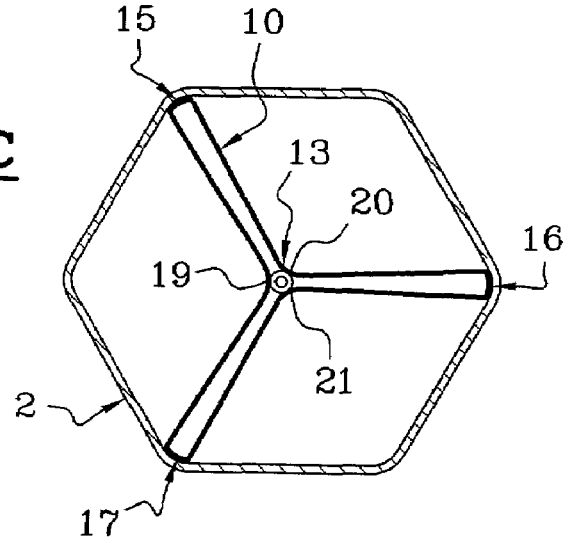

The embodiment of FIGS. 6A–6C differs from the previous embodiment in that the cross sections of the external container 2 and of the pouch 10 are hexagonal instead of square. The fixing regions 15, 16, 17 lie along the axes of symmetry of order 3, that is to say along every second corner.

Just as in the previous embodiment, as pumping progresses, the profile of the pouch portions lying between two consecutive fixing regions may invert, substantially symmetrically with respect to the plane containing the two consecutive fixing regions, until they come into contact with the dip tube 13 as three longitudinal regions 19, 20, 21. In this position, the volume of the flexible pouch is minimal. In all other respects, the way in which this embodiment works is substantially identical to the operation of the previous embodiment.

Figure 7:
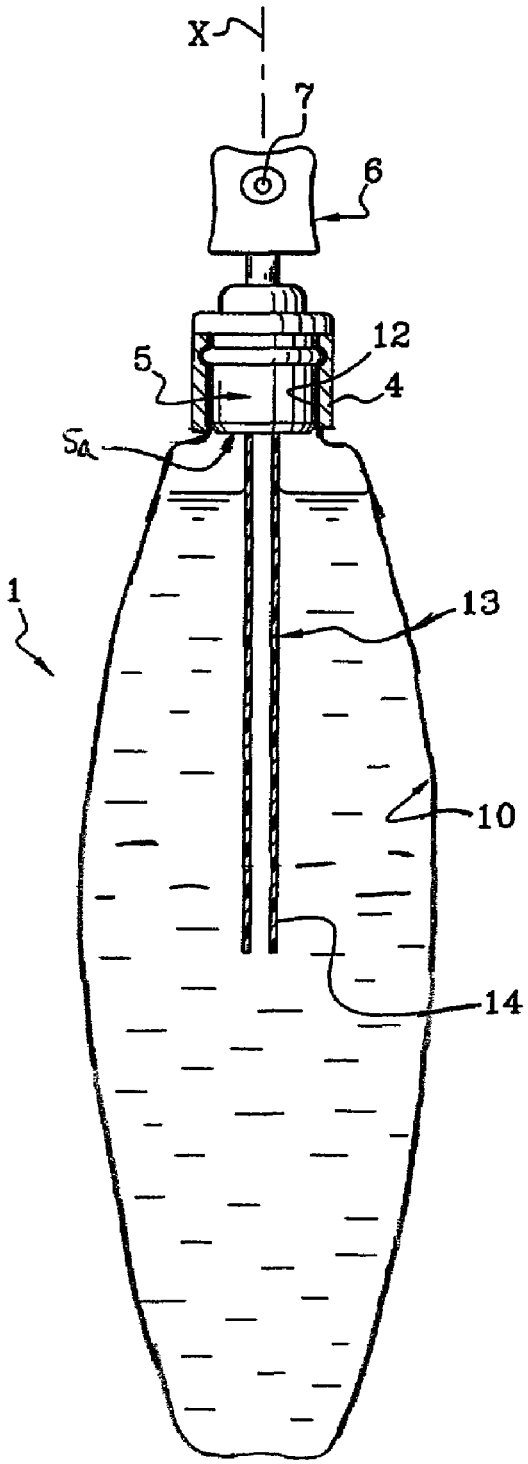
FIG. 7 is a cross sectional view of a third exemplary embodiment.

FIG. 7 shows a view in longitudinal section of a device according to another exemplary embodiment. The device of this embodiment is similar to the device of FIG. 1, but it does not have an outer container. Neck 4 terminates at approximately a lower edge 5*a* of pump 5. Open edge 12 of the pouch is thus retained in neck 4 in a fashion similar to that of the device of FIG. 1.

According to this embodiment, the pouch 10 could still be configured to deform in a manner so that the level of product contained in the pouch remains substantially constant throughout the use of the device. In addition, pouch 10 may also be capable of deforming substantially symmetrically with respect to a plane bisecting a transverse cross section of the pouch. This may be accomplished by the properties of the pouch material itself, for example. It is also contemplated that an internal/external frame could be supplied on the interior/exterior of the pouch to serve a similar function as that of the fixing region(s) of the device of FIG. 1.

Also, according to the invention, it may be possible to shorten the length of the dip tube so that the free end does not extend to the mid-point of the axial height of the pouch, but extends some distance less than that. Alternatively, it might be possible to lengthen the dip tube.

It will be apparent to those skilled in the art that various modifications and variations can be made to the structure. Thus, it should be understood that the invention is not limited to the examples discussed in the specification. Rather, the present invention is intended to cover modifications and variations.

What is claimed is:

1. A device for dispensing a product, comprising:

a container;

a flexible-walled pouch inside the container, the flexible-walled pouch comprising an interior;

a product contained in the interior of the pouch;

a dip tube extending in the interior of the pouch, the dip tube having a free end located substantially at a mid-point of an axial height of the pouch, the dip tube having an opening at the free end of the dip tube, the opening being the only inlet for the flow of product into the dip tube;

an airless pump in fluid communication with the interior of the flexible-walled pouch via the dip tube; and at least one passage configured to allow air entry into the container and outside of the pouch, wherein pressure in the interior of the pouch, at least prior to first use of the device, is less than or substantially equal to atmospheric pressure, and wherein the device is configured so that, as product is pumped from the interior of the pouch, a volume defined by the interior of the pouch above the free end of the dip tube is substantially equal to a volume defined by the interior of the pouch below the free end of the dip tube.

2. The device of claim 1, wherein the passage is configured to allow the air entry as the product is pumped from the pouch.

3. The device of claim 1, wherein said pouch is fixed longitudinally to an interior of the container along at least one fixing region.

4. The device of claim 3, wherein the pouch and the at least one fixing region are configured so that as product is pumped from inside the interior of the pouch, a volume defined by the pouch decreases while cross sections of the pouch located along at least a portion of its axial height remain substantially symmetrical with respect to a mid cross sectional plane containing the free end of the dip tube.

5. The device of claim 4, wherein the device is configured so that as the product is pumped from the interior of the pouch, cross sections of the pouch located along said at least a portion of its axial height maintain a substantially symmetric shape with respect to an axis containing the dip tube.

6. The device of claim 1, wherein the pouch is configured to move from a first position, wherein the pouch defines a maximum volume, to a second position, wherein the pouch defines a minimum volume.

7. The device of claim 6, wherein said pouch, when in the second position, is close to the dip tube along at least one longitudinal region.

8. The device of claim 6, wherein said pouch, when in the second position, contacts the dip tube along at least one longitudinal position.

9. The device of claim 6, wherein an internal cross shape defined by the container is similar to a shape of the pouch when the pouch is in the first position.

10. The device of claim 3, wherein the at least one fixing region comprises a plurality of fixing regions, and wherein the pouch and the plurality of fixing regions are configured so that a profile of a portion of the pouch extending between two adjacent fixing regions deforms substantially symmetrically with respect to a plane passing through an axis of the dip tube and a midpoint between the two adjacent fixing regions.

11. The device of claim 3, wherein the at least one fixing region extends continuously along substantially the entire height of the pouch.

12. The device of claim 6, wherein cross sections of the pouch have a symmetric shape about an axis.

13. The device of claim 12, wherein the pouch has at least four sides when the pouch is in the first position.

14. The device of claim 13, wherein the pouch is fixed to the container along N longitudinal fixing regions.

15. The device of claim 14, wherein N is greater than or equal to three.

16. The device of claim 12, wherein when the pouch is in the first position, the pouch has a square shaped cross section having four sides with a longitudinal fixing region being located at the middle of each of the four sides.

17. The device of claim 1, wherein a cross sectional area defined by the pouch is at a maximum substantially at the mid-point of the axial height of the pouch and decreases gradually away from the mid-point.

18. The device of claim 1, wherein the at least one passage comprises one or more orifices formed in a bottom of the external container.

19. The device of claim 18, wherein the orifices comprise slots.

20. The device of claim 1, wherein the device is formed by co-extrusion of a first material forming the container and a second material forming the pouch, the first material being physically and chemically incompatible with the second material.

21. The device of claim 20, wherein the pouch is fixed longitudinally to an interior of the container along at least one fixing region, and wherein the at least one fixing region comprises a third material that is physically and chemically compatible with said first material and second material.

22. The device of claim 21, wherein the third material comprises a thermoplastic.

23. The device of claim 20, wherein the first material is chosen from polyethylene terephthalates, ABSs, and styrenes.

24. The device of claim 20, wherein the second material is chosen from polypropylenes and polyethylenes.

25. The device of claim 21, wherein the third material is a resin.

26. The device of claim 1, wherein the pump is mounted on the device by at least one of crimping and screwing.

27. The device of claim 1, further comprising a dispensing head for actuating the pump and dispensing product via at least one dispensing orifice.

28. The device of claim 1, wherein the product comprises a cosmetic product.

29. The device of claim 28, wherein the cosmetic product is chosen from personal hygiene products, scents, makeup products, hair products, care products, and sunscreens.

30. The device of claim 1, wherein the pouch is formed of a substantially non-elastic material.

31. The device of claim 30, wherein the material is deformable.

32. The device of claim 1, wherein the dip tube is an unperforated cylindrical tube.

33. A device for dispensing a product, comprising:

a container;

a flexible-walled pouch inside the container, the flexible-walled pouch comprising an interior configured to contain the product;

a dip tube extending in the interior of the pouch, the dip tube having a free end located substantially at a mid-point of an axial height of the pouch, the dip tube having an opening at the free end of the dip tube, the opening being the only inlet for the flow of product into the dip tube;

an airless pump in fluid communication with the interior of the flexible-walled pouch via the dip tube; and at least one passage configured to allow air entry into the container and outside of the pouch, wherein a cross sectional area defined by the pouch is at a maximum substantially at the mid-point of the axial height of the pouch, and decreases gradually away from the mid-point, and wherein the flexible pouch comprises a substantially non-elastically deformable material.

34. The device of claim 33, wherein the passage is configured to allow the air entry as the product is pumped from the pouch.

35. The device of claim 33, wherein said pouch is fixed longitudinally to an interior of the container along at least one fixing region.

36. The device of claim 35, wherein the pouch and the at least one fixing region are configured so that, as product is pumped from the interior of the pouch, a volume defined by the interior of the pouch above the free end of the dip tube is substantially equal to a volume defined by the interior of the pouch below the free end of the dip tube.

37. The device of claim 35, wherein the pouch and the at least one fixing region are configured so that as product is pumped from inside the interior of the pouch, a volume defined by the pouch decreases while cross sections of the pouch located along at least a portion of its axial height remain substantially symmetrical with respect to a mid cross sectional plane containing the free end of the dip tube.

38. The device of claim 37, wherein the pouch and the at least one fixing region are configured so that as the product is pumped from the interior of the pouch, cross sections of the pouch located along said at least a portion of its axial height maintain a substantially symmetric shape with respect to an axis containing the dip tube.

39. The device of claim 33, wherein the pouch is configured to move from a first position, wherein the pouch defines a maximum volume, to a second position, wherein the pouch defines a minimum volume.

40. The device of claim 39, wherein said pouch, when in the second position, is close to the dip tube along at least one longitudinal region.

41. The device of claim 39, wherein said pouch, when in the second position, contacts the dip tube along at least one longitudinal position.

42. The device of claim 39, wherein an internal cross shape defined by the container is similar to a shape of the pouch when the pouch is in the first position.

43. The device of claim 35, wherein the at least one fixing region comprises a plurality of fixing regions, and wherein the pouch and the plurality of fixing regions are configured so that a profile of a portion of the pouch extending between two adjacent fixing regions deforms substantially symmetrically with respect to a plane passing through an axis of the dip tube and a midpoint between the two adjacent fixing regions.

44. The device of claim 35, wherein the at least one fixing region extends continuously along substantially the entire height of the pouch.

45. The device of claim 39, wherein cross sections of the pouch have a symmetric shape about an axis.

46. The device of claim 45, wherein the pouch has at least four sides when the pouch is in the first position.

47. The device of claim 46, wherein the pouch is fixed to the container along N longitudinal fixing regions.

48. The device of claim 47, wherein N is greater than or equal to three.

49. The device of claim 45, wherein when the pouch is in the first position, the pouch has a square shaped cross section having four sides with a longitudinal fixing region being located at the middle of each of the four sides.

50. The device of claim 33, wherein a cross sectional area defined by the pouch is at a maximum substantially at the mid-point of the axial height of the pouch and decreases gradually away from the mid-point.

51. The device of claim 33, wherein the at least one passage comprises one or more orifices formed in a bottom of the external container.

52. The device of claim 51, wherein the orifices comprise slots.

53. The device of claim 33, wherein the device is formed by co-extrusion of a first material forming the container and a second material forming the pouch, the first material being physically and chemically incompatible with the second material.

54. The device of claim 53, wherein the pouch is fixed longitudinally to an interior of the container along at least one fixing region, and wherein the at least one fixing region comprises a third material that is physically and chemically compatible with said first material and second material.

55. The device of claim 54, wherein the third material comprises a thermoplastic.

56. The device of claim 53, wherein the first material is chosen from polyethylene terephthalates, ABSs, and styrenes.

57. The device of claim 53, wherein the second material is chosen from polypropylenes and polyethylenes.

58. The device of claim 54, wherein the third material is a resin.

59. The device of claim 33, wherein the pump is mounted on the device by at least one of crimping and screwing.

60. The device of claim 33, further comprising a dispensing head for actuating the pump and dispensing product via at least one dispensing orifice.

61. The device of claim 33, further comprising product contained in the interior of the pouch, wherein the product comprises a cosmetic product.

62. The device of claim 61, wherein the cosmetic product is chosen from personal hygiene products, scents, makeup products, hair products, care products, and sunscreens.

63. The device of claim 33, wherein the dip tube is an unperforated cylindrical tube.

64. A device for dispensing a product, comprising:

a container;

a flexible-walled pouch inside the container, the flexible-walled pouch comprising an interior configured to contain the product;

a dip tube extending in the interior of the pouch, the dip tube having a free end located substantially at a mid-point of an axial height of the pouch;

an airless pump in fluid communication with the interior of the flexible-walled pouch via the dip tube; and at least one passage configured to allow air entry into the container and outside of the pouch, wherein said pouch is fixed longitudinally to an interior wall of the container along at least one fixing region, wherein a cross sectional area defined by the pouch is at a maximum substantially at the mid-point of the axial height of the pouch, and decreases gradually away from the mid-point, and wherein the pouch and the at least one fixing region are configured so that, as product is pumped from the interior of the pouch, a volume defined by the interior of the pouch above the free end of the dip tube is substantially equal to a volume defined by the interior of the pouch below the free end of the dip tube.

65. The device of claim 64, wherein the passage is configured to allow the air entry as the product is pumped from the pouch.

66. The device of claim 64, wherein the pouch and the at least one fixing region are configured so that as product is pumped from inside the interior of the pouch, a volume defined by the pouch decreases while cross sections of the pouch located along at least a portion of its axial height remain substantially symmetrical with respect to a mid cross sectional plane containing the free end of the dip tube.

67. The device of claim 66, wherein the pouch and the at least one fixing region are configured so that as the product is pumped from the interior of the pouch, cross sections of the pouch located along said at least a portion of its axial height maintain a substantially symmetric shape with respect to an axis containing the dip tube.

68. The device of claim 64, wherein the pouch is configured to move from a first position, wherein the pouch defines a maximum volume, to a second position, wherein the pouch defines a minimum volume.

69. The device of claim 68, wherein said pouch, when in the second position, is close to the dip tube along at least one longitudinal region.

70. The device of claim 68, wherein said pouch, when in the second position, contacts the dip tube along at least one longitudinal position.

71. The device of claim 68, wherein an internal cross shape defined by the container is similar to a shape of the pouch when the pouch is in the first position.

72. The device of claim 64, wherein the at least one fixing region comprises a plurality of fixing regions, and wherein the pouch and the plurality of fixing regions are configured so that a profile of a portion of the pouch extending between two adjacent fixing regions deforms substantially symmetrically with respect to a plane passing through an axis of the dip tube and a midpoint between the two adjacent fixing regions.

73. The device of claim 64, wherein the at least one fixing region extends continuously along substantially the entire height of the pouch.

74. The device of claim 68, wherein cross sections of the pouch have a symmetric shape about an axis.

75. The device of claim 74, wherein the pouch has at least four sides when the pouch is in the first position.

76. The device of claim 75, wherein the pouch is fixed to the container along N longitudinal fixing regions.

77. The device of claim 76, wherein N is greater than or equal to three.

78. The device of claim 68, wherein when the pouch is in the first position, the pouch has a square shaped cross section having four sides with a longitudinal fixing region being located at the middle of each of the four sides.

79. The device of claim 64, wherein the dip tube has an opening at the free end of the dip tube, the opening being the only inlet for the flow of product into the dip tube.

80. The device of claim 64, wherein the dip tube is an unperforated cylindrical tube.

81. The device of claim 64, wherein the at least one passage comprises one or more orifices formed in a bottom of the external container.

82. The device of claim 81, wherein the orifices comprise slots.

83. The device of claim 64, wherein the device is formed by co-extrusion of a first material forming the container and a second material forming the pouch, the first material being physically and chemically incompatible with the second material.

84. The device of claim 83, wherein the pouch is fixed longitudinally to an interior of the container along at least one fixing region, and wherein the at least one fixing region comprises a third material that is physically and chemically compatible with said first material and second material.

85. The device of claim 84, wherein the third material comprises a thermoplastic.

86. The device of claim 83, wherein the first material is chosen from polyethylene terephthalates, ABSs, and styrenes.

87. The device of claim 83, wherein the second material is chosen from polypropylenes and polyethylenes.

88. The device of claim 84, wherein the third material is a resin.

89. The device of claim 64, wherein the pump is mounted on the device by at least one of crimping and screwing.

90. The device of claim 64, further comprising a dispensing head for actuating the pump and dispensing product via at least one dispensing orifice.

91. The device of claim 64, further comprising product contained in the interior of the pouch, wherein the product comprises a cosmetic product.

92. The device of claim 91, wherein the cosmetic product is chosen from personal hygiene products, scents, makeup products, hair products, care products, and sunscreens.

93. The device of claim 64, wherein the pouch is formed of a substantially non-elastic material.

94. The device of claim 93, wherein the material is deformable.

* * * * *